US008579009B2

(12) United States Patent
Messick, Jr.

(10) Patent No.: US 8,579,009 B2
(45) Date of Patent: Nov. 12, 2013

(54) HANGER ASSEMBLY FOR ARCHITECTURAL MESH UNDER EXTREME LOADS

(75) Inventor: George Howard Messick, Jr., E. New Market, MD (US)

(73) Assignee: Cambridge International, Inc., Cambridge, MD (US)

( * ) Notice: Subject to any disclaimer, the term of this patent is extended or adjusted under 35 U.S.C. 154(b) by 0 days.

(21) Appl. No.: 11/702,618

(22) Filed: Feb. 6, 2007

(65) Prior Publication Data

US 2007/0227091 A1 Oct. 4, 2007

Related U.S. Application Data

(60) Provisional application No. 60/765,210, filed on Feb. 6, 2006.

(51) Int. Cl.
*A47H 13/00* (2006.01)

(52) U.S. Cl.
USPC ..... 160/368.1; 160/383; 160/403

(58) Field of Classification Search
USPC ..... 160/368.1, 327, 328, 329, DIG. 15, 383, 160/403; 52/342, 343, 443, 454, 506.05, 52/506.06, 506.08, 63; 248/251–272, 248/225.11, 225.21, 220.22, 205.1, 292.13, 248/125.2, 125.7, 215, 317, 324, 340; 40/603, 604, 606.15
See application file for complete search history.

(56) References Cited

U.S. PATENT DOCUMENTS

| | | | | | |
|---|---|---|---|---|---|
| 170,040 | A | * | 11/1875 | Youngs | 5/220 |
| 844,571 | A | * | 2/1907 | Wikander et al. | 160/31 |
| 1,347,126 | A | * | 7/1920 | Sell | 248/254 |
| 1,606,401 | A | * | 11/1926 | Craft | 211/1 |
| 1,606,986 | A | * | 11/1926 | Clark | 160/328 |
| 1,960,095 | A | * | 5/1934 | Tonnesen | 38/102 |
| 1,980,618 | A | * | 11/1934 | Gaines | 160/89 |
| 2,088,072 | A | * | 7/1937 | Tobin | 160/328 |
| 2,251,415 | A | * | 8/1941 | O'Donnell | 160/329 |
| 2,535,305 | A | * | 12/1950 | Loepsinger | 248/571 |
| 2,553,980 | A | * | 5/1951 | Ostrander | 43/14 |
| 2,934,782 | A | * | 5/1960 | Wootton | 16/93 D |
| 3,091,045 | A | * | 5/1963 | De Vilbiss | 160/328 |
| 3,695,329 | A | * | 10/1972 | Roller | 160/84.06 |
| 4,416,463 | A | * | 11/1983 | Marsh et al. | 280/79.3 |
| 5,388,794 | A | * | 2/1995 | Wolff | 248/219.4 |
| 5,555,659 | A | * | 9/1996 | Hade | 40/604 |

(Continued)

OTHER PUBLICATIONS

The American Heritage® Dictionary of the English Language, Fourth Edition copyright © 2000 by Houghton Mifflin Company. Updated in 2009. Published by Houghton Mifflin Company. All rights reserved. Downloaded from http://www.thefreedictionary.com/mesh Definition provided in office action mailed with this Notice.*

*Primary Examiner* — Katherine Mitchell
*Assistant Examiner* — Jaime F Cardenas-Garcia
(74) *Attorney, Agent, or Firm* — Buchanan Ingersoll & Rooney PC

(57) ABSTRACT

An architectural mesh hanging system including a hanger assembly for an architectural mesh panel of predetermined size and a mechanism for mounting the hanger assembly on a support surface, the mounting mechanism including a plurality of support brackets connected to the hanger assembly and at least one of the support brackets including a pivotable support bracket.

19 Claims, 5 Drawing Sheets

(56) References Cited

U.S. PATENT DOCUMENTS

| | | | | |
|---|---|---|---|---|
| 6,192,611 | B1 * | 2/2001 | Molla | 40/604 |
| 6,339,889 | B1 * | 1/2002 | Griesemer et al. | 40/603 |
| 6,370,802 | B1 * | 4/2002 | Boyer et al. | 40/603 |
| 6,578,250 | B2 * | 6/2003 | Boyer et al. | 29/446 |
| 6,945,300 | B2 * | 9/2005 | Smith | 160/89 |
| 2002/0014315 | A1 * | 2/2002 | Toffey | 160/45 |
| 2003/0150171 | A1 * | 8/2003 | Kunzel et al. | 52/63 |
| 2006/0090862 | A1 * | 5/2006 | Messick, Jr. | 160/330 |

* cited by examiner

HANGER ASSEMBLY FOR ARCHITECTURAL MESH UNDER EXTREME LOADS

CROSS-REFERENCE TO RELATED APPLICATION

This application claims priority to provisional application U.S. Ser. No. 60/765,210, filed Feb. 6, 2006, the entire contents of which are hereby incorporated by reference.

TECHNICAL FIELD

The present invention is directed to an apparatus for securing architectural mesh and, more particularly, to a hanger assembly for the installation of architectural mesh and the like under extreme load conditions.

BACKGROUND

Architectural metallic meshes are generally used in commercial and business environments to provide elegant wall panels, doors and other surfaces whenever an aesthetic appearance of polish and prestige are of primary importance. Architectural mesh is also an excellent choice for high contact areas, such as the interior walls of elevator cabs, escalator walls, and sales and reception areas, because it is generally scratch, dent and corrosion resistant. As such, architectural metallic mesh maintains a stunning appearance with minimal maintenance.

Woven into panels from brass, stainless steel, copper, and/or other desired metals or alloys, architectural mesh offers a richness of texture, pattern and color that cannot be duplicated by any other material. Architectural mesh can also be polished, finished and combined with different background colors to create a custom look and configuration.

Depending upon the chosen weave, the interstices or apertures between the weft or fill wires and the warp wires may allow light to pass through the architectural mesh. Alternatively, if the weave is tight and the wires are more closely adjacent to one another, the passage of light through the mesh will be selectively prevented. Accordingly, as the requirement for incorporating energy savings into building design increases, and hence the need for architecturally acceptable sun shading or screening, architectural mesh offers a variety of options that can meet the shading needs while still maintaining architectural requirements.

One type of hanging system for mounting architectural mesh to building exteriors comprises a hanger assembly including a hanger tube having a plurality of openings; an architectural mesh panel having an uppermost edge defined by a plurality of loops, wherein said plurality of loops are positioned within said plurality of openings in said hanger tube; and a retaining rod which is disposed through said plurality of loops within an interior of said hanger tube, thereby preventing said plurality of loops from displacement out of said plurality of opening and securing the architectural mesh panel in position. This type of hanger bar assembly is described more fully in U.S. patent application Ser. No. 11/265,211, the entire contents of which are incorporated herein.

A further type of hanging system for mounting architectural mesh to building exteriors comprises a plurality of tube hanger brackets supporting a tube, preferably a rectangular box tube, having a predetermined length suitable for the width of the architectural mesh panel. A plurality of hanger plates are disposed about the periphery of the box tube, each hanger plate having a plurality of sprocket teeth extending from a surface thereof so as to engage the architectural mesh. The architectural mesh is wrapped from the upper surface of the hanger plate around the plurality of plate sprocket teeth and then extends vertically down. At the upper surface of the hanger plate, an opening is provided for receiving a retainer rod. Thus, the retainer rod extends through each hanger plate and engages a loop of the mesh forming the architectural panel. A retainer pin disposed on each terminal end of the box tube further secures the mesh against horizontal movement. Moreover, because the mesh material is wrapped around the hanger plate and the box tube, these supporting elements are substantially hidden from view when the architectural panel is installed in the desired application; thus not detracting from the aesthetic appeal of the architectural panel. This type of hanger assembly is described more fully in U.S. patent application Ser. No. 11/235,086, the entire contents of which are incorporated herein.

The architectural mesh utilized in the above systems has an inherent spring rate, and thus additional springs are generally not necessary. That is, when an average wind load of up to approximately 70 mph sustained winds is applied to the architectural mesh panel, tension is generated in the mesh which can then be absorbed by the inherent spring rate of the mesh itself.

A need exists, however, for an architectural mesh panel which can handle extreme wind loads and associated airborne debris such as occurs in hurricanes and tornados. Additionally, there is a need for architectural mesh panels which can reduce the shock and/or impact loads from explosions and their associated shrapnel. One manner to accomplish this task would be to develop heavier architectural mesh panels with higher spring rates, and then provide heavy duty mounting systems and attachment mechanisms as described above. However, this type of heavy duty architectural mesh panel and hanging system would be cost prohibitive to manufacture and difficult to install due to the additional weight.

Thus, it would be desirable to provide an economical system for reliably and conveniently mounting an architectural mesh product which can withstand extreme loads to a building exterior, without detracting from the aesthetic appearance of the building.

SUMMARY

These and other objects of the invention are achieved by an architectural mesh hanging system according to the present invention. The hanging system comprises a hanger assembly including a hanger tube mounted to a support structure by upper and lower wall brackets. At least one of the wall brackets, and preferably the lower wall bracket, is an overload "break-away" bracket including a fixed member and a pivoting member. A pivot point "P" is defined between the fixed member and the pivoting member and pivotal movement is controlled by a spring which may comprise any type of gas or mechanical spring or cylinder. Under extreme loads, such as when high force winds are applied to the architectural mesh, the spring is compressed to absorb some of the loading. In this instance, slack is introduced into the system, thus increasing the deflection of the architectural mesh and in turn, reducing the overall tension in the system.

More particularly, a preferred embodiment of the present invention is directed to a hanger bar assembly for architectural mesh comprising a hanger bar comprising a hollow tube, means for mounting said hanger bar on a support surface, and means for supporting architectural mesh within said hanger bar. The mounting means preferably comprise a plurality of support brackets connected to said hanger bar, at least one of said support brackets including a pivotable support bracket. Further, the pivotable support bracket preferably includes a fixed member and a pivotable member and movement of the pivotable support bracket member is controlled by at least one spring.

A further aspect of the present invention is directed to an architectural mesh hanging system comprising a hanger assembly for an architectural mesh panel of predetermined size and means for mounting said hanger assembly on a support surface; wherein said mounting means comprises a plurality of support brackets connected to said hanger assembly, and at least one of said support brackets includes a pivotable support bracket. The pivotable support bracket includes a fixed member and a pivotable member and is controlled by at least one spring. According to a preferred embodiment of the invention, the pivotable support bracket is fully extended by the at least one spring under normal conditions and the pivotable support bracket is compressible by the at least one spring under extreme loads such that the spring thereby absorbs a portion of the load.

BRIEF DESCRIPTION OF THE DRAWINGS

These and other objects, features, and advantages of the present invention will become more readily apparent to those skilled in the art upon reading the following detailed description, in conjunction with the appended drawings in which.

DETAILED DESCRIPTION OF THE PREFERRED EMBODIMENTS

Figure 1:
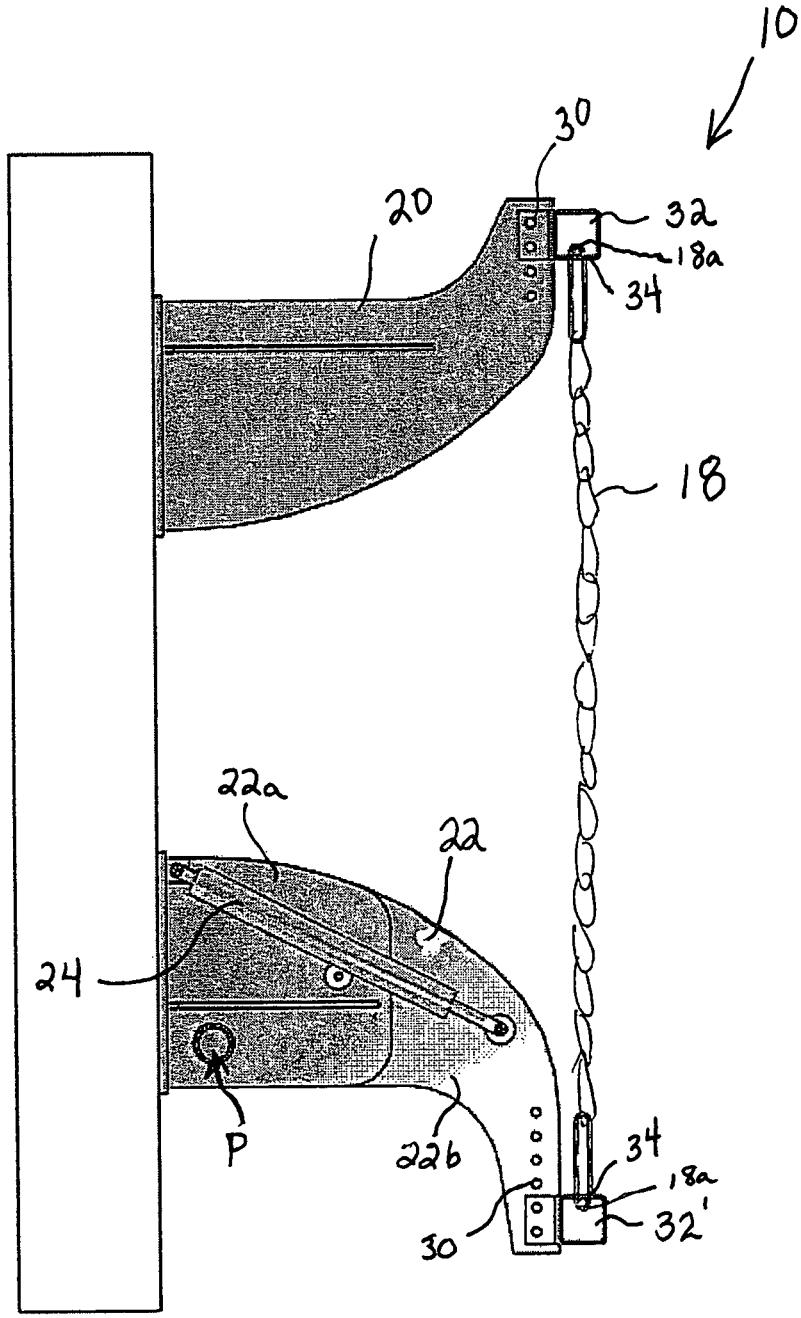
FIG. 1 is a side elevational view of the hanger assembly of the present invention in a normal condition.

The hanger assembly of the present invention is designated generally by reference numeral 10, as shown in FIG. 1. Although a predetermined length hanger assembly 10 is illustrated in the drawings, it will be understood by one skilled in the art that depending upon the width of the panel of architectural mesh, the hanger assembly will extend generally along the entire width of said panel.

Figure 2:
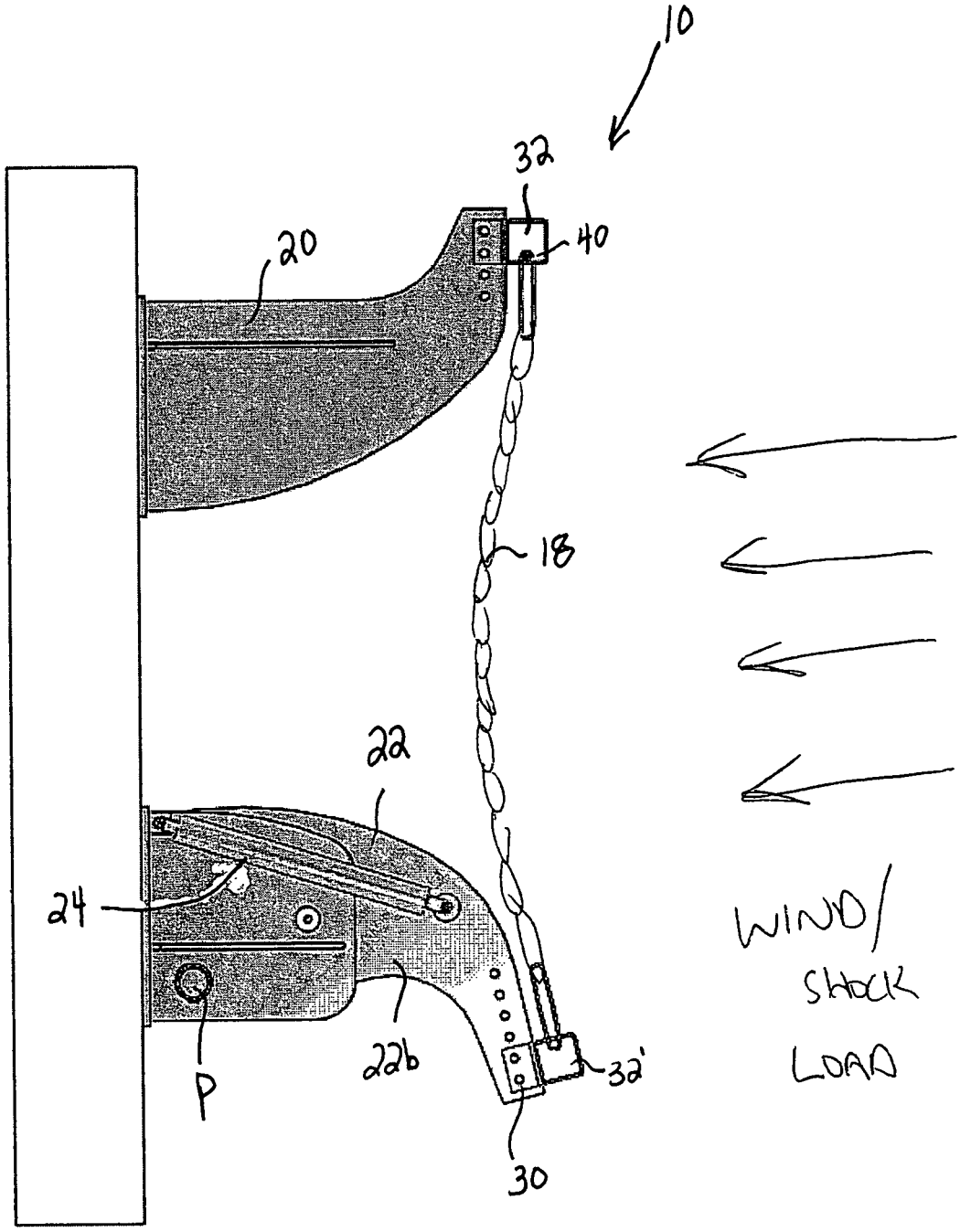
FIG. 2 is a side elevational view of the hanger assembly in a load condition.
Figure 3:
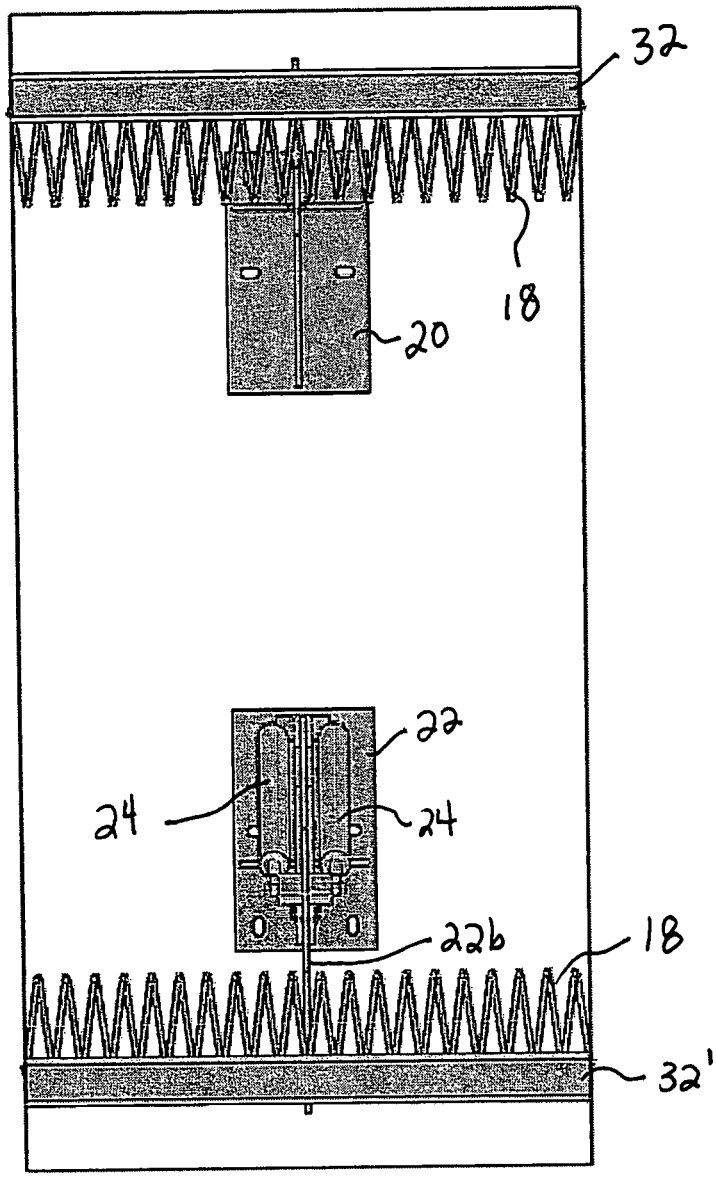
FIG. 3 is a front elevational view of the hanger assembly, the architectural mesh panel being broken away for clarity.

Referring also to FIGS. 2 and 3, the hangar assembly 10 preferably includes hanger tubes 32, 32', preferably box tubes disposed at an upper and lower vertical edge of a section of architectural mesh 18 or a similar metal configuration. The hanger assembly 10 includes an upper wall bracket 20 and a lower wall bracket 22 preferably attached to a vertical support surface disposed parallel to the desired hanging plane of the architectural mesh sunscreen 18. In the preferred embodiment, the hanger tubes 32, 32' include a plurality of slots 34 on one surface thereof, as shown best in FIGS. 1 and 2. The mesh 18, and more particularly each of the endmost loops 18*a* of the mesh 18, extends through a respective one of the slots 34 and into the interior of the hanger tubes 32, 32'. Within the hanger tubes, each of the endmost loops 18*a* receives a retainer rod 40 extending the length of the hanger tube 32, 32'. Thus, the retainer rod 40 extends through the hanger tube 32, 32' and engages the loops 18*a* of the mesh 18 forming the architectural panel. A retainer pin 42 disposed on each terminal end of the tubes 32, 32' may further secure the rod 40 against horizontal movement. Moreover, because the endmost loop of the mesh material and the retaining rod 40 are within the hanger tubes 32, 32', these supporting elements are substantially hidden from view when the architectural panel 18 is installed in the desired application; thus not detracting from the aesthetic appeal of the architectural panel 18.

The slotted box tubes 32, 32' are mounted to the upper and lower brackets 20, 22. In order to accommodate system slack and to allow the mesh 18 to handle moderate wind loads, the mounting may utilize springs, slots, or multiple mounting holes 30 as shown in FIGS. 1 and 2. As will be appreciated by one skilled in the art, other types of mounting systems could of course also be used.

Figure 4:
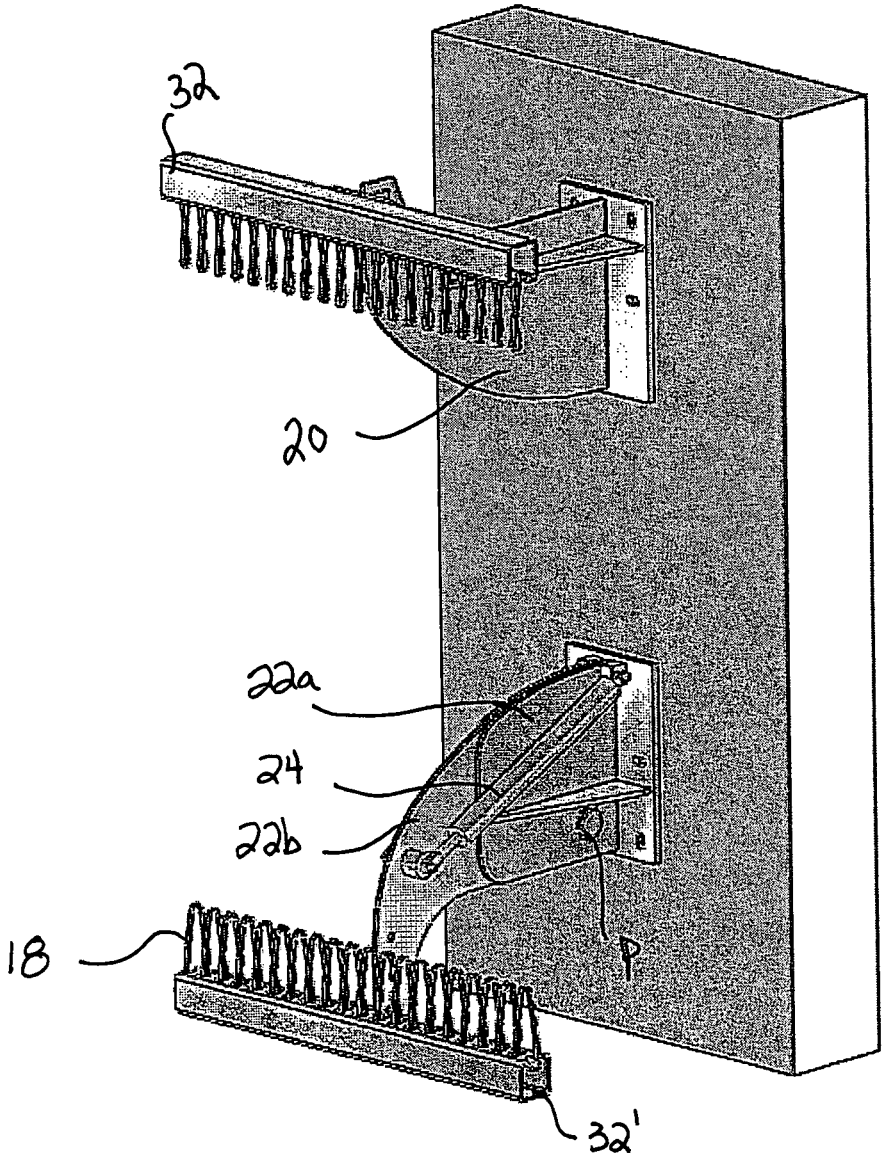
FIG. 4 is a perspective view of the hanger assembly in a normal condition.
Figure 5:
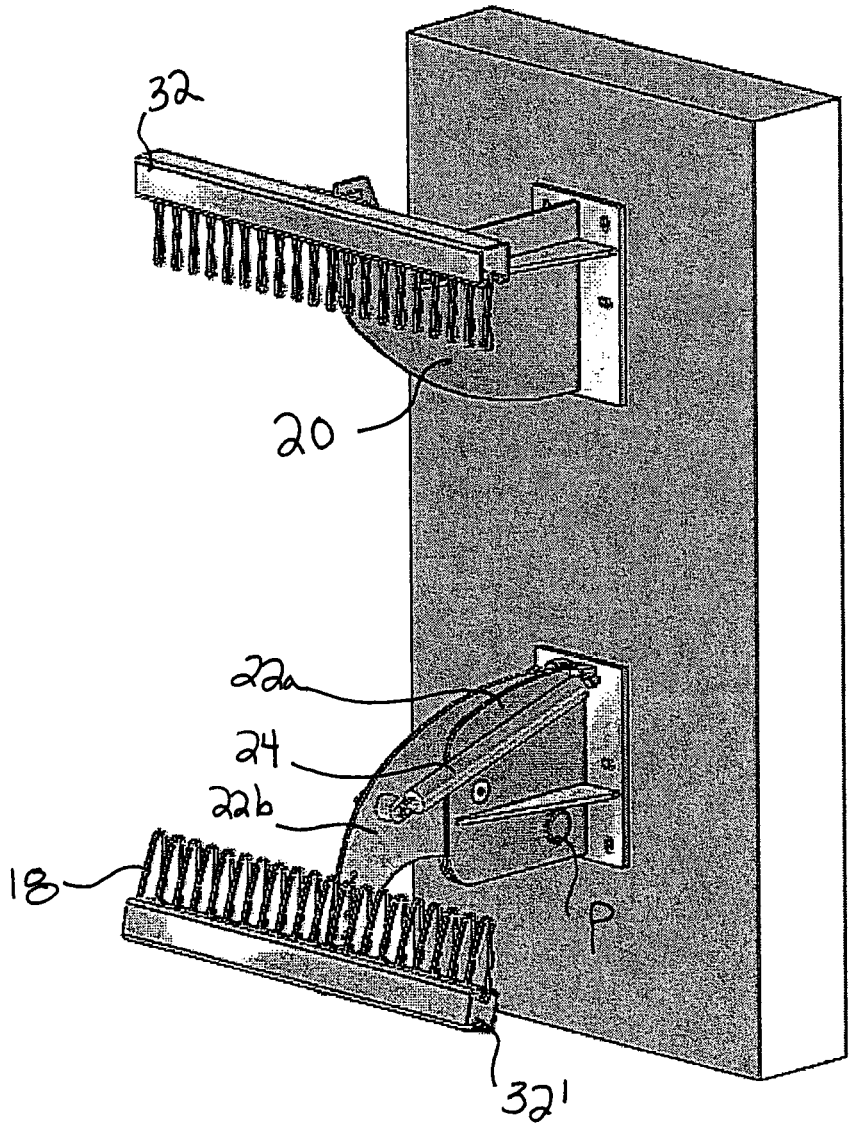
FIG. 5 is perspective view of the hanger assembly in a load condition.

Referring to FIGS. 1-3, the lower wall bracket 22 is an overload "break-away" system preferably including a fixed member 22*a* and a pivoting member 22*b*. A pivot point "P" is defined between the fixed member 22*a* and the pivoting member 22*b* and pivotal movement is controlled by one or more springs 24 which may comprise any type of gas or mechanical spring or cylinder. As shown in FIG. 3, a spring 24 is preferably disposed on each side of the fixed member 22*a* and pivoting member 22*b*. The break-away spring 24, as well as the number of springs 24 used for a given panel width, is sized dependent upon the shock/wind load that is to be absorbed. An important design consideration is that the system is intended to operate with the architectural mesh acting as a resilient spring, i.e., due to its inherent ability, under moderate conditions 70-90 mph winds, while having a heavier duty break-away system for extreme loads. This breakaway system can include mechanical springs, shear pins, gas shocks, and the like, as long as it would allow slack into the system at extreme loads. Gas springs are preferred as they can handle multiple high loadings without having to be repaired. As shown in FIGS. 1 and 4, the lower wall bracket 22 is held at full extension by the spring 24 under normal conditions. Under extreme loads, such as when high force winds are applied to the architectural mesh, the spring 24 is compressed to absorb some of the loading. In this instance, as shown in FIGS. 2 and 5, slack is introduced into the system, thus increasing the deflection of the architectural mesh 18 and in turn, reducing the tension in the system.

Thus, by mounting the slotted tube hanging systems on an overload bracket 22, the architectural mesh can absorb minor loads under normal conditions and the break away system allows additional tension relief when needed for extreme loads. By selecting the inherent spring rate of the architectural mesh, the yield strength of the architectural mesh, the break-away strength of the spring 24, and the number of break-away springs 24 to be used for a given architectural mesh panel, a cost effective system for handling extreme loads is provided.

The above-described preferred embodiment illustrates upper and lower box tubes for hanging the architectural mesh 18, and upper wall bracket 20 and lower break-away bracket 22 for attaching the hanging mechanism to the support structure. One skilled in the art will appreciate however than other mechanisms and structures for hanging the architectural mesh 18 can of course also be used, such as those described in the above-referenced U.S. patent application Ser. Nos. 11/265,211 and 11/235,086, and any other type of known hanging system. The significance of the present invention is the use of a pivotable break-away bracket 22, which while described and shown to be a lower wall bracket could certainly also be used as an upper bracket if desired.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention.

The invention claimed is:

1. A hanger bar assembly for architectural mesh comprising:

a hanger bar comprising a hollow tube;

means for supporting architectural mesh within said hanger bar; and a plurality of support brackets fixedly and directly engaging said hanger bar for mounting said hanger bar on a support surface, at least one of said support brackets including a pivotable support bracket, said pivotable support bracket comprising a fixed member and a pivoting member pivotally connected to one another about a single pivot point, said fixed member and said pivoting member being substantially cantilevered relative to the support surface; and at least one spring directly connecting said pivoting member of said pivotable support bracket to said fixed member of said pivotable support bracket at an intermediate portion of said pivoting member;

wherein, when under normal architectural mesh hanging conditions, said fixed member and said pivoting member are maintained at full extension by said spring; and wherein, when under extreme load architectural mesh hanging conditions, said at least one spring is compressed such that said pivoting member pivots relative to said fixed member.

2. The hanger bar assembly of claim 1, wherein said plurality of support brackets includes an upper support bracket and a lower support bracket.

3. The hanger bar assembly of claim 1, wherein said means for supporting architectural mesh comprises a plurality of openings in said hanger bar and a retaining rod.

4. The hanger bar assembly of claim 1, wherein said mounting means further comprises a plurality of mounting holes in each of said plurality of support brackets.

5. The hanger bar assembly of claim 1, wherein movement of said pivotable support bracket member is controlled by said at least one spring.

6. The hanger bar assembly of claim 5, wherein said at least one spring comprises a gas or mechanical spring.

7. The hanger bar assembly of claim 5, wherein said at least one spring comprises a gas or mechanical cylinder.

8. The hanger bar assembly of claim 1, wherein said pivotable support bracket is compressible by said at least one spring such that said at least one spring thereby absorbs a portion of a load.

9. The hanger bar assembly of claim 1, wherein said at least one spring comprises a first spring end and a second spring end, said first spring end being secured to said fixed member and said second spring end being secured to said pivoting member.

10. The hanger bar assembly of claim 1, wherein said hanger bar defines a longitudinal axis along a length thereof, said pivoting member being rotatable relative to said fixed member about a rotational axis, the rotational axis being parallel to the longitudinal axis of said hanger bar.

11. An architectural mesh hanging system comprising:

a hanger assembly for an architectural mesh panel of predetermined size, and a plurality of support brackets fixedly and directly engaging said hanger assembly for mounting said hanger assembly on a support surface, at least one of said support brackets including a pivotable break-away support bracket, said pivotable break-away support bracket comprising a fixed member and a pivoting member pivotally connected to one another about a single pivot point, said fixed member and said pivoting member being substantially cantilevered relative to the support surface; and at least one spring directly connecting said fixed member of said pivotable break-away support bracket to said pivoting member of said pivotable break-away support bracket at an intermediate portion of said pivoting member;

wherein, when under normal architectural mesh hanging conditions, said fixed member and said pivoting member are maintained at full extension by said spring; and wherein, when under extreme load architectural mesh hanging conditions, said at least one spring is compressed such that said pivoting member pivots relative to said fixed member.

12. The hanging system of claim 11, wherein said plurality of support brackets includes an upper support bracket and a lower support bracket.

13. The hanging system of claim 11, wherein said mounting means further comprises a plurality of mounting holes in each of said plurality of support brackets.

14. The hanging system of claim 11, wherein movement of said pivotable support bracket member is controlled by said at least one spring.

15. The hanging system of claim 14, wherein said at least one spring comprises a gas or mechanical spring.

16. The hanging system of claim 14, wherein said at least one spring comprises a gas or mechanical cylinder.

17. The hanging system of claim 11, wherein said pivotable support bracket is compressible by said at least one spring such that said at least one spring thereby absorbs a portion of a load.

18. The hanging system of claim 11, wherein said at least one spring comprises a first spring end and a second spring end, said first spring end being secured to said fixed member and said second spring end being secured to said pivoting member.

19. The hanging system of claim 11, wherein said pivoting member is rotatable relative to said fixed member about a rotational axis.

* * * * *